US008328102B2

(12) United States Patent
Rapoport et al.

(10) Patent No.: US 8,328,102 B2
(45) Date of Patent: Dec. 11, 2012

(54) METHOD AND AUTHENTICATION APPARATUS FOR AUTHENTICATING VALUE DOCUMENTS

(75) Inventors: William R. Rapoport, Bridgewater, NJ (US); James Kane, Lawrenceville, NJ (US); Carsten Lau, Garbsen (DE)

(73) Assignee: Honeywell International Inc., Morristown, NJ (US)

( * ) Notice: Subject to any disclaimer, the term of this patent is extended or adjusted under 35 U.S.C. 154(b) by 126 days.

(21) Appl. No.: 12/970,212

(22) Filed: Dec. 16, 2010

(65) Prior Publication Data

US 2011/0147450 A1 Jun. 23, 2011

Related U.S. Application Data

(60) Provisional application No. 61/288,597, filed on Dec. 21, 2009.

(51) Int. Cl.
*G06K 7/10* (2006.01)
*G06K 19/06* (2006.01)

(52) U.S. Cl. ..... 235/491; 235/468

(58) Field of Classification Search ..... 235/468, 235/491

See application file for complete search history.

(56) References Cited

U.S. PATENT DOCUMENTS

| | | | | |
|---|---|---|---|---|
| 4,146,792 | A * | 3/1979 | Stenzel et al. | 250/365 |
| 4,979,200 | A | 12/1990 | Umemoto et al. | |
| 5,270,162 | A | 12/1993 | Shiraishi et al. | |
| 5,525,798 | A * | 6/1996 | Berson et al. | 250/271 |
| 5,599,578 | A | 2/1997 | Butland | |
| 5,674,698 | A | 10/1997 | Zarling et al. | |
| 6,610,351 | B2 * | 8/2003 | Shchegolikhin et al. | 427/7 |
| 6,613,137 | B2 | 9/2003 | Egger et al. | |
| 6,706,314 | B2 | 3/2004 | Butland | |
| 6,802,992 | B1 | 10/2004 | Wieczoreck et al. | |
| 6,841,092 | B2 | 1/2005 | Paeschke et al. | |
| 7,030,371 | B2 | 4/2006 | Vasic et al. | |
| 7,241,399 | B2 | 7/2007 | Haubold et al. | |
| 7,323,696 | B2 | 1/2008 | Vann et al. | |
| 7,501,646 | B2 * | 3/2009 | Ross et al. | 250/559.39 |
| 7,926,730 | B2 * | 4/2011 | Auslander et al. | 235/494 |
| 2002/0130303 | A1 | 9/2002 | Muth et al. | |
| 2004/0200902 | A1 | 10/2004 | Ishioroshi | |
| 2005/0068395 | A1 | 3/2005 | Haubold et al. | |
| 2005/0098738 | A1 | 5/2005 | Laney et al. | |
| 2005/0205846 | A1 | 9/2005 | Bley et al. | |
| 2005/0260764 | A1 | 11/2005 | Grigsby, Jr. et al. | |
| 2006/0131425 | A1 | 6/2006 | Stenzel et al. | |

(Continued)

FOREIGN PATENT DOCUMENTS

GB 2 088 920 A 6/1982

(Continued)

*Primary Examiner* — Jamara Franklin

(74) *Attorney, Agent, or Firm* — Ingrassia Fisher & Lorenz, P.C.

(57) ABSTRACT

Taggants can be incorporated into or onto value documents. The taggants comprise a crystalline taggant doped with two rare earth ions. The substrate or printed matter into which the taggant can be incorporated has a minimal absorption infrared wavelength window and the taggant is excited by incident infrared radiation in this wavelength range. Suitable first rare earth ions function as efficient broad band absorbers of incident infrared radiation and passes energy non-radiatively to a second rare earth ion, which emits infrared radiation at a wavelength greater than the incident infrared radiation. The emitted infrared radiation is also in the minimal absorption transmission window of the printed matter or the substrate into which the taggant is incorporated. Methods of authenticating the value document include detection of the emitted radiation at pre-determined values.

18 Claims, 5 Drawing Sheets

U.S. PATENT DOCUMENTS

| | | | | |
|---|---|---|---|---|
| 2006/0180792 | A1 | 8/2006 | Ricci et al. | |
| 2007/0087195 | A1 | 4/2007 | Meyer et al. | |
| 2007/0295116 | A1 | 12/2007 | Le Mercier et al. | |
| 2008/0135623 | A1 | 6/2008 | Leenders et al. | |
| 2008/0252065 | A1 | 10/2008 | Giering et al. | |
| 2008/0290649 | A1 | 11/2008 | Klein et al. | |
| 2011/0147614 | A1* | 6/2011 | Kane et al. | 250/459.1 |

FOREIGN PATENT DOCUMENTS

| | | | |
|---|---|---|---|
| GB | 2 258 660 | A | 2/1993 |
| JP | 2002-212552 | A | 7/2002 |
| WO | 00/60527 | A1 | 10/2000 |
| WO | 2006079810 | A1 | 8/2006 |
| WO | 2009/053391 | A2 | 4/2009 |

* cited by examiner

METHOD AND AUTHENTICATION APPARATUS FOR AUTHENTICATING VALUE DOCUMENTS

CROSS-REFERENCE TO RELATED APPLICATIONS

This application claims the benefit of U.S. Provisional Application Ser. No. 61/288,597, filed Dec. 21, 2009.

TECHNICAL FIELD

The technical field relates generally to a method and validation apparatus that authenticates a stationary or moving value document using infrared excitation and infrared emission of a covert composition incorporated within colored printed matter of value documents.

BACKGROUND

There are many ways to validate a value document, from simple to complex. Some methods involve visible (i.e. overt) features on or incorporated into a document, such as a hologram on a credit card, an embossed image or watermark on a bank note, a security foil, a security ribbon, colored threads or colored fibers within a bank note, or a floating and/or sinking image on a passport. While these features are easy to detect with the eye and may not require equipment for authentication, these overt features are easily identified by a would-be forger and/or counterfeiter. As such, in addition to overt features, hidden (i.e. covert) features may be incorporated in value documents. Covert features include invisible fluorescent fibers, chemically sensitive stains, fluorescent pigments or dyes that are incorporated into the substrate of the value document. Covert features may also be included in the ink that is printed onto the substrate of the value document or within the resin used to make films that are used in laminated value documents. Since covert features are not detectable by the human eye, detectors configured to detect these covert features are needed to authenticate the value document.

There are many validation systems (e.g. covert features and corresponding detectors) that are used to, for instance, authenticate bank notes. For example, U.S. Pat. No. 4,446,204 to Kaule, et al. discloses a security paper with authenticable features in the form of added or applied coloring agents which on the one hand make it possible to check the IR-transmission properties of the security paper, if appropriate, even in the printed image, and on the other hand have magnetic properties, wherein both IR Transmission and magnetic tests can be uninfluenced by one another but are capable of being carried out at the same position on the security paper. Known detection devices are then used to match detectors to the differently lying spectral region of the authenticable features for validation.

Further, U.S. Pat. No. 5,679,959 to Nagase discloses a bill discriminating apparatus that includes a light source for projecting a stimulating light onto a surface of a bill, a photomultiplier that photoelectrically detects the light emitted from the bill surface in response to the irradiation with the stimulating light and producing detected data corresponding to an amount of the detected light, a ROM for storing reference data, and a central processing unit ("CPU") for comparing the detected data produced by the photomultiplier and the reference data stored in the ROM. Such a system, however, fails to detect a counterfeit document when the detected emitted radiation from the counterfeit is similar to the authentic emitted radiation parameter.

Many known validation systems involve detecting a covert authenticatable feature and evaluating its emission spectra. If the emissions alone are detected, then the value document is deemed authentic, otherwise it is rejected as a counterfeit. One problem with this type of existing validation system arises when the authenticatable feature is entirely contained in the printed matter, such as an ink, on a substrate because it is subjected to wear and attrition loss. As a result, there is unpredictable deterioration of the authenticatable feature's emission spectra amplitude, and thus, the authentication apparatus may incorrectly identify an authentic document as a counterfeit. Another problem involves that fact that over time, this method has become less secure since counterfeiters have become more sophisticated and have greater access to scientific apparatus that can detect the incorporation of these features in value documents.

There are existing validation systems that involve detecting the decay time of a phosphor that is excited by a visible or ultraviolet light source in a stationary situation. For example, U.S. Pat. No. 7,030,371 to Vasic et al. discloses security documents or articles carrying luminescent marker compounds which show a time-deferred emission characteristic which are authenticated by a method and device that allows for rapid extraction of characteristic luminescent parameters, such as emission intensity and time constants. In addition, U.S. Publication No. 20090152468 to Allen et al. discloses a technique and apparatus for detecting infrared radiation emitted from a taggant material sample following the excitation of the sample by accurately measuring the decay time of the radiation of the particular taggant being used. These systems, however, do not involve detection and authentication of moving value documents.

A number of prior art patents, including for example, U.S. Pat. No. 6,686,074 to Muth et al discloses using two rare earth ion containing phosphors that absorb incident exciting electromagnetic radiation wavelength and emit electromagnetic radiation at a shorter wavelength due to anti-stokes processes. The anti-stokes process is inefficient with a conversion efficiency of only a few percent and the shorter wavelength radiation emitted may be readily absorbed by the pigments present in the printing ink.

U.S. Pat. No. 5,932,139 to Oshima et al. discloses fluorescent substance, fluorescent composition, fluorescent mark carrier and optical reader thereof. The fluorescent ink deposit contains a fluorescent substance with Nd, Yb and Er oxysalts such as vanadate, phosphate, borate, molybdate and tungstate or organic materials. The fluorescent material is capable of emitting a fluorescent light of a wavelength different from that of the exciting light with a larger wavelength, a typical down conversion process effect. While the emission wavelength is in the infrared range, the absorption is only indicated to occur in the visible or near infrared spectral region. The ink used has dyes that are absorptive in the visible region of the spectrum therefore the energy absorbed by the fluorescent material is small. In the near infrared region, the fluorescent substance has only narrow line absorption and therefore, most of the incident radiation is not absorbed by the fluorescent substance and as a result the emitted infrared intensity has a small intensity.

Notwithstanding the existing validation systems for authenticating value documents, there exists a need for a system that reliably and accurately detects stationary or moving value documents, such as systems involved with sorting or detecting bank notes. The validation system should incorporate security features in and/or on the value document that are difficult to replicate and should have detection discrimination methods and features that are unique and complicated enough to prevent counterfeiting and forging of the value document. It is also important that these value documents such as bank notes can be authenticated at high speeds.

SUMMARY OF THE INVENTION

In one aspect, a taggant is provided for use in printed matter on value documents. The taggant includes an inorganic crystal lattice which comprises at least a first rare earth active ion and a second rare earth active ion. The first rare earth active ion absorbs exciting incident infrared radiation having a first wavelength of about 1300 to about 2200 nm, and transfers the absorbed infrared radiation to the second rare earth active ion, and the second rare earth active ion emits infrared radiation at a second wavelength of about 1400 to about 2200 nm that is greater than the first wavelength of the exciting incident infrared radiation.

In another aspect, a method is provided for authenticating a value document. The method includes: a) providing a value document to an authentication apparatus, the value document comprising printed matter, the printed matter comprising a taggant including an inorganic crystal lattice that includes at least a first rare earth active ion and a second rare earth active ion, wherein the first rare earth active ion absorbs exciting incident infrared radiation having a first wavelength of about 1300 to about 2200 nm and transfers the absorbed infrared radiation to the second rare earth active ion, and the second rare earth active ion emits infrared radiation at a second wavelength that is greater than the first wavelength of the exciting incident infrared radiation; b) providing exciting incident infrared radiation of the first wavelength to the taggant with an infrared illumination source of the authentication apparatus; c) detecting infrared radiation emitted from the second rare earth active ion with an infrared detector of the authentication apparatus and producing emission data from the infrared detector; d) verifying that the emission data is within pre-selected validation criteria with a processing unit of the authentication apparatus; and e) outputting authentication data from the processing unit to authenticate or reject the value document.

BRIEF DESCRIPTION OF THE DRAWINGS

Specific examples have been chosen for purposes of illustration and description, and are shown in the accompanying drawings, forming a part of the specification.

DETAILED DESCRIPTION OF THE INVENTION

Figure 1:
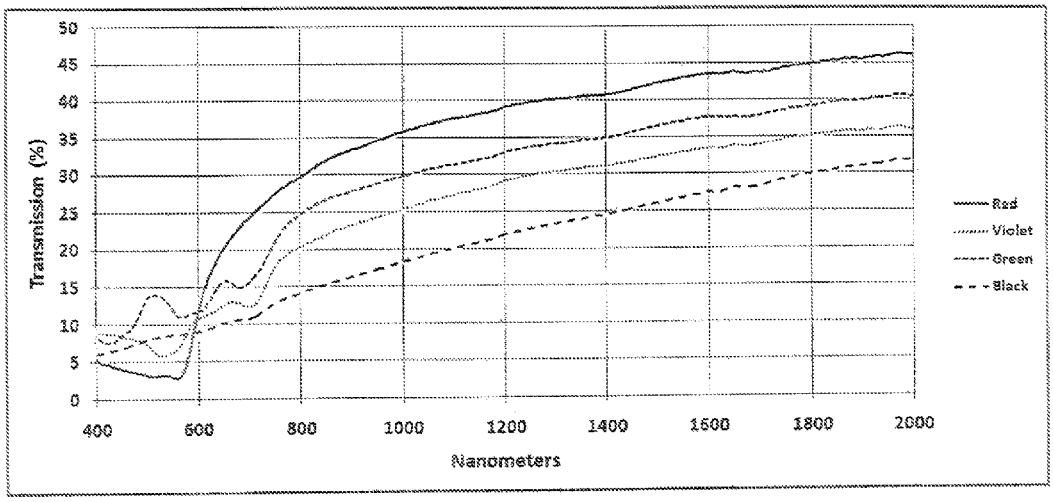
FIG. 1 illustrates measured transmission (absorption being equal to 1-transmission indicated) for typical red ink, green ink, violet ink and black ink indicating availability of high transmission spectral region in the infrared wavelengths beyond 1000 nm infrared wavelength.

This present technology relates to taggants that can be incorporated in or onto value documents, and to methods for authenticating a value document comprising a taggant incorporated within printed matter. Value documents of the present technology include a substrate, and may also include at least one area of printed matter. In some examples, such as for example when the substrate is colored, the taggants can be incorporated into the substrate. The substrate may be any suitable substrate for a value documents, including but not limited to paper and plastic materials. Taggants can also be incorporated into the printed matter. The printed matter, such as an ink, may be any color including black. The amount of absorption in the visible spectral range of the printed matter depends on its color. For instance, when the printed matter is black, spectrographic analysis shows that it absorbs across the visible spectrum. The present technology recognizes that substrates and printed matter of all colors, including black, tend to have significantly reduced absorption in the infrared portion of the spectrum, regardless of the color, and the infrared transmission through colored matter increases as infrared wavelengths increase. As such, a taggant with rare earth active ions may be added into the substrate or the material used to create the printed matter, such as an ink, wherein it efficiently absorbs incident exciting infrared radiation and emits infrared signal in the infrared spectral region having reduced absorption coefficient. The taggant can be hidden in the substrate or the printed matter, completely invisible to a user of the value document and upon routine examination of the value document. The rare earth active ions may also exhibit absorption and emission below 1000 nm, but the coloration of the substrate or ink with its absorption properties greatly reduces the excitation and the emission in those spectral areas. Excitation of the rare earth active ions in the taggant further into the IR (beyond 1300 nm) will not excite the emission lines that are spectrally below 1300 nm. This property further masks the presence of the taggant in the substrate or printed matter increasing its value as a security feature.

Suitable taggants for use with the present technology are efficiently excited by infrared incident radiation with a wavelength in the highly transparent window of the printed matter and emits infrared radiation having a longer wavelength within the highly transparent window of the printed matter. The efficiency of the infrared emission process from the taggant increases when the excitation wavelengths are closer to the emission wavelengths of the taggant. Also, since the excitation wavelengths in the infrared wavelength region may be greater than some of the conventional emission wavelengths of the taggant emitter, those conventional emission wavelength transitions are not excited when the greater excitation wavelength is used for excitation allowing the efficiency of the desired emission to be greater.

Suitable taggants also absorb exciting infrared radiation as a band absorber, rather than as a narrow line absorber, by having at least two rare earth active ions incorporated within the crystalline lattice of the taggant. A band absorber absorbs incident infrared radiation over a wide spectral range of infrared wavelengths and therefore can be sufficiently excited by infrared illumination sources such as LEDs. Some absorption lines associated with the rare earth active ions in the taggant are narrow band absorbers below 1000 nm. These narrow band absorption lines can be very strong, but since they are also narrow, there is very poor spectral overlap with inexpensive light sources such as LEDs. The narrow bandwidth and spectral location can also create significant challenges to find and tune a laser diode to that absorption line.

The total energy absorbed by a taggant is related to the absorption cross-section of the taggant over the wavelengths of incident exciting radiation, the overall thickness of the printed matter comprising the taggant and the excitation source spectra. In general, excitation sources include laser diodes and LEDs. Laser diodes can emit a large number of photons in a very narrow wavelength, but must be tuned to the absorption peaks for best performance. In addition, the use of laser diodes in this type of application is undesirable for required optical safety control reasons. LEDs exhibit increasing spectral width from the UV to the IR region. The wide spectral width is generally a poor spectral match to the narrow absorption line in the visible region of the active ion within the taggant. As the wavelengths increase towards the IR region; however, LEDs are a good spectral match since many ions exhibit wide band absorptions in this region. In addition, LEDs are a cost effective solution and are available in spectral regions in the IR.

Taggants of the present technology can include at least two rare earth active ions. While not intending to be bound to any theory, it is believed that upon exciting the taggant, the excitation photon is absorbed by a first rare-earth active ion and decays to a storage level. In at least some examples, the first rare-earth active ion absorbs the incident exciting radiation by broad band absorption, meaning that the absorption feature of the first rare-earth active ion is wide, such as from about 20 nm to about 50 nm, or greater. That energy is then non-radiatively transferred to a second rare earth active ion incorporated within the same crystalline lattice of the taggant and is then emitted as a photon of higher wavelength characteristic of the second rare earth active ion. High intensity emission requires high absorption of incident exciting photons. It has been found that taggants comprising rare earth active ions typically absorb incident infrared radiation as narrow line absorbers in the exciting infrared wavelength range of about 400 nm to about 900 nm, while some of the rare earth active ions in the taggants exhibit broad band absorption in the infrared wavelength range of about 1300 nm to about 2200 nm. The emission lines of a taggant that arise from transitions that terminate near the ground state also are absorbers in the same spectral area. The taggants that absorb incident exciting infrared radiation at infrared wavelength of about 1500 nm to about 1900 nm are easily excited by commercial LEDs. When the first rare-earth active ion absorbs the incident exciting radiation by broad band absorption, a low power LED will sufficiently excite a suitable taggant. High intensity infrared radiation emitted by the second rare earth active ion in the taggant at a wavelength typically in the range of about 1700 nm to about 2200 nm is easily and reliably detected by a commercially available extended InGaAs detector available from Teledyne Judson Technologies, Montgomeryville, Pa. Suitable infrared detectors receive emitted infrared radiation from the second rare earth active ion at a pre-selected wavelength.

In at least some examples, an ink may be used to create the printed matter on the value document. Accordingly, an ink can be provided that comprises a taggant of the present technology. The ink can also comprise other components suitable for rendering the ink printable and otherwise useful for its intended application on a value document. For example, the ink can include at least one liquid or gel into which the taggant is mixed and suspended. The ink can then be printed onto a value document to provide printed matter that comprises the taggant. Due to the high efficiency of transfer of photonic energy from the LED lamp to the taggant incorporated in the printed matter, the taggant transfers a large amount of energy non-radiatively to the emission energy levels of a second rare earth ion providing an emission from the second ion. As such, the ink can include small quantities taggant, including for example, taggant in an amount from about 0.01% to about 40% by weight of the ink, or from about 0.01% to about 5% by weight of the ink. Inks tend to lose very little weight upon drying, so the printed matter on a value document is expected to have about the same amount of taggant as the initial ink that is printed to form the printed matter. For measurement purposes, the amount of taggant in the printed matter can be considered to be the same as the amount of taggant in the ink. Accordingly, taggant can be present in the printed matter on a value document in an amount from about 0.01% to about 40% by weight of the printed matter, including but not limited to, amounts of about or from about 0.1% by weight of the printed matter, about 0.5% by weight of the printed matter, about 1% by weight of the printed matter, about 2% by weight of the printed matter, about 5% by weight of the printed matter, about 10% by weight of the printed matter, about 15% by weight of the printed matter, about 20% by weight of the printed matter, about 25% by weight of the printed matter, about 30% by weight of the printed matter, or about 35% by weight of the printed matter. In some examples, taggant can be present in the printed matter on a value document in an amount from about 0.01% to about 5% by weight of the printed matter. Preferably, the amount of taggant in the printed matter is sufficient so that even when the printed matter on a value document such as a bank note is worn, there will be sufficient taggant within the printed matter to recognize and validate an authentic value document.

In examples where the taggant is incorporated directly into a substrate, the taggant can be present in the substrate in any suitable amount, including for example, from about 0.01% to about 40% by weight of the substrate, including but not limited to, amounts of about or from about 0.1% by weight of the substrate, about 0.5% by weight of the substrate, about 1% by weight of the substrate, about 2% by weight of the substrate, about 5% by weight of the substrate, about 10% by weight of the substrate, about 15% by weight of the substrate, about 20% by weight of the substrate, about 25% by weight of the substrate, about 30% by weight of the substrate, or about 35% by weight of the substrate. In some examples, taggant can be present in the substrate of a value document in an amount from about 0.01% to about 5% by weight of the substrate. Preferably, the amount of taggant in the substrate is sufficient so that even when the printed matter on a value document such as a bank note is worn, there will be sufficient taggant within the substrate to recognize and validate an authentic value document.

Suitable host materials comprising rare earth active ions for taggants to be used in the present technology include inorganic crystalline lattices selected from a group consisting of aluminates, borates, garnets, oxides, silicates, fluorides, germanates, molybdates, oxyfluorides, oxysulfides, phosphates, tungstates, niobates, tantalates, vanadates, and combinations thereof. At least two active ions are incorporated within the lattice of the taggant as dopants and substitute for certain ions in the host lattice. The absorption and emission characteristics of the rare earth active ions used to substitute host lattice ions in the crystalline lattice matrix of the taggant are affected by the energy levels of the specific rare earth ions used as well as by effects from the crystal field. The active ions may be selected from a group consisting of rare earth elements such as erbium, holmium, thulium, praseodymium, dysprosium, neodymium, or other suitable rare earth elements and mixtures thereof. The active ions typically substitute for ions such as yttrium, lanthanum or gadolinium in the crystal lattice. One of the active ions for example, erbium exhibits broad band absorption of the incident infrared radiation in the range about 1400 nm to about 1700 nm, non-radiatively transfers this energy to a second rare earth active ion selected from the active ions listed above, which emits infrared radiation in the about 1600 nm to about 2200 nm range.

The present technology relates to a value document authentication apparatus that authenticates a value document having a substrate or printed matter comprising a taggant of the present technology. The value document authentication apparatus may include an infrared illumination source, an infrared detector that receives emitted infrared radiation from the taggant at a pre-selected wavelength; and at least one processing unit. The one or more processing units, such as a computer, may be used to store true and/or test emission data. The emission data is obtained from detecting the optical emission from the second rare earth active ion using a suitable infrared detector and filter. This signal is electronically captured and checked to verify that the values are within the pre-determined authentication limits which then authenticates or rejects the test value document based on those pre-determined pass/fail parameters.

The present technology also relates to a method of authenticating a value document by examining a value document that includes a taggant comprising at least two rare earth active ions, one of which absorbs exciting incident infrared light having a first wavelength, including but not limited to a wavelength in the range of about 1400 to about 1900 nm, and the second of which emits infrared radiation having a second wavelength, including but not limited to a wavelength in the range of about 1600 to about 2200 nm. The value document is examined by an extended InGaAs detector or other suitable detectors that are sensitive to light in the wavelength range of about 1000 nm to about 2200 nm. The detection system may include optical filters in the optical path that only pass a pre-selected wavelength range emitted by the taggant. This examination of authenticity may be made when the value document is stationary or moving for example in a high speed bank note authentication and counting machine. This method detects and rejects value documents without the taggant with a high degree of reliability.

The present technology may increase the security and authenticity precision of a validation system by measuring infrared emission from a covert taggant incorporated within the printed matter of a value document when the taggant is excited by incident infrared radiation corresponding to an absorption band of the first rare earth active ion. Both the incident infrared wavelength and the emission infrared wavelength fall within the range of wavelengths minimally absorbed by printed ink regardless of printed ink color. Thus, the covert taggant may be hidden within dark areas of the value document invisible to human eye or most common detection methods including ultraviolet screening. Since the taggants only emit infrared radiation at a known specific band of wavelengths based on the active ions as influenced by the host lattice, detection requires a properly selected combination of infrared detector and optical filter, thus increasing the security of the value document.

The printed matter, such as ink, for value documents including bank notes comes in many colors. The absorption properties of an ink in the visible spectrum provide the color that the human eye perceives. As mentioned above, a black ink absorbs most of the wavelengths within the visible spectrum. Thus, the printed matter has strong absorption properties if the taggant exciting light source falls within the absorption spectra of the colored matter. In a similar manner, any emission from the taggant in the higher absorption range of the printed matter is also significantly reduced and no useful detection signal is generated. The transmission (1-absorption) measured in the infrared wavelength range increases to a very high transmission value as the wavelength of the light increases. This increase in transmission or reduction in absorption is seen beyond infrared wavelengths greater than 1000 nm.

FIG. 1 illustrates measured absorption spectra for typical inks including a red ink, green ink, violet ink and black ink. Each of the colored inks shows a different spectral transmission behavior to create colors that are perceived by the human eye in reflection. Inks of all colors show low infrared absorption especially beyond 1000 nm in the infrared wavelength region. Additionally, infrared transmission is seen to improve as infrared wavelength increases. Thus, if a taggant were to be excited by incident infrared exciting radiation, the radiation is available for absorption by the taggant regardless of the color of the printed ink or its printed density. As a result, the taggant may be hidden in heavily printed dark areas of a value document completely invisible to a user of the value document providing a secure authentication feature. The subject technology relates to using a printed ink that exhibits reduced absorption in the spectral window of the incident exciting radiation required for exciting the taggant.

Figure 2A:
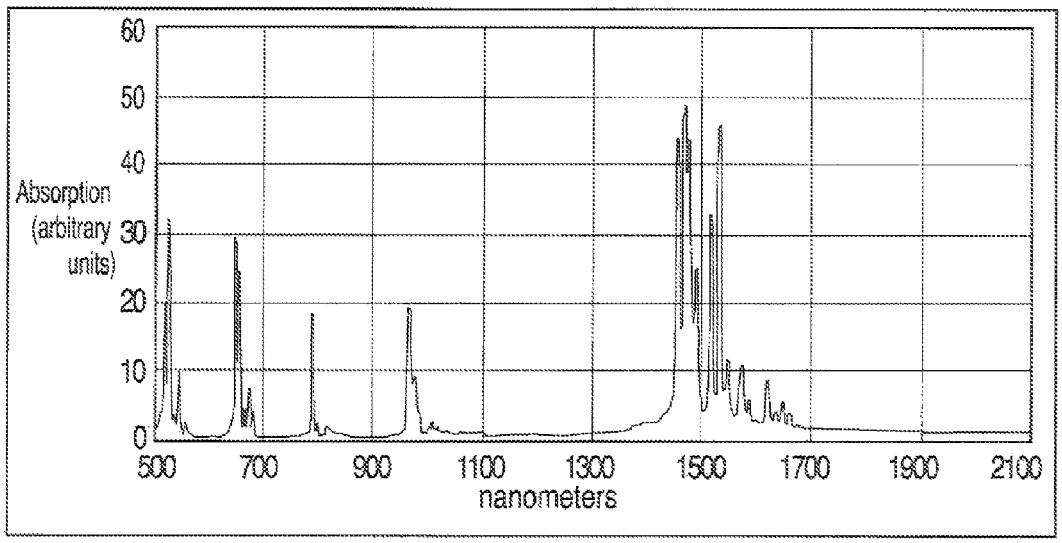
FIGS. 2*a* and 2*b* show similar absorption curves illustrating the measured absorption behavior of a typical inorganic yttrium aluminum garnet doped with erbium rare earth ions showing narrow line absorption behavior below 1100 nm and wide band absorption in the 1400 to 1700 nm infrared wavelength range.
Figure 2B:
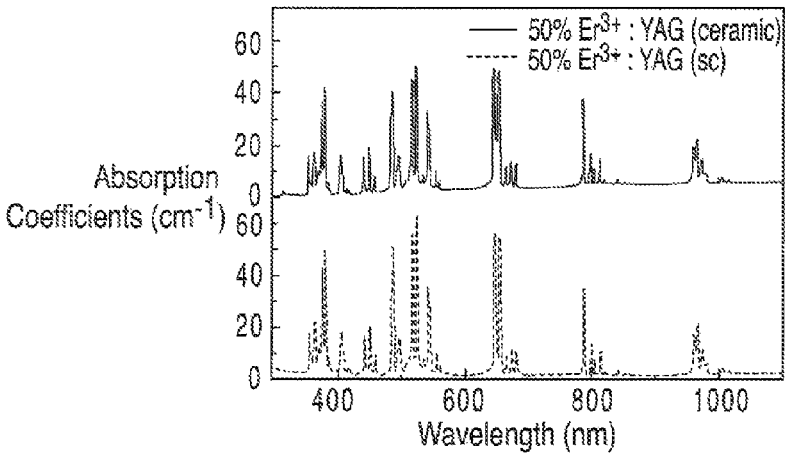

Erbium is a rare earth active ion that functions as a broad band absorber to absorb the incident taggant exciting radiation from an infrared LED. FIGS. 2*a* and 2*b* illustrate the measured absorption data of a typical known inorganic yttrium aluminum garnet doped with erbium rare earth active ions and shows narrow line absorption behavior below about 1100 nm and broad band absorption in the infrared wavelength range from about 1400 to about 1700 nm as shown in FIG. 1. FIGS. 2*a* and 2*b* show similar absorption curves as disclosed in the publication by Sardar et al. "Absorption intensities and emission cross section of principal intermanifold and inter-Stark transitions of $Er^{3+}(4f^{11})$ polycrystalline ceramic garnet $Y_3Al_5O_{12}$," Journal of Applied Physics, 97, 123501 (2005), which shows absorption behavior only up to 1100 nm. The wavelength of the broad band absorption is seen to coincide with the high transmission infrared wavelength range of printed ink as shown in FIG. 1 and therefore, the taggant embedded in the printed ink may be easily excited without attenuation by the printed ink in the infrared wavelength range 1400 to 1700 nm. Commercial LED devices such as Marubeni L1550-03 available from Marubeni America Corporation, California, USA, which is an InGaAs LED lamp that emits a spectral band of radiation that peaks at 1550 nm may be used as an incident light source for photonic exciting of the taggant. There are other LED lamp sources that are commercially available that would be useful in the present technology and would be known to one skilled in the art. Because the photon excitation of the taggant is carried out at 1550 nm, the more energetic electronic transitions that result in shorter wavelength emissions are not excited and absorbed photon energy is non-radiatively transferred to a second rare earth ion whose energy levels result in higher wavelength emission with wavelengths in the range of about 1600 to about 2200 nm.

Figure 3:
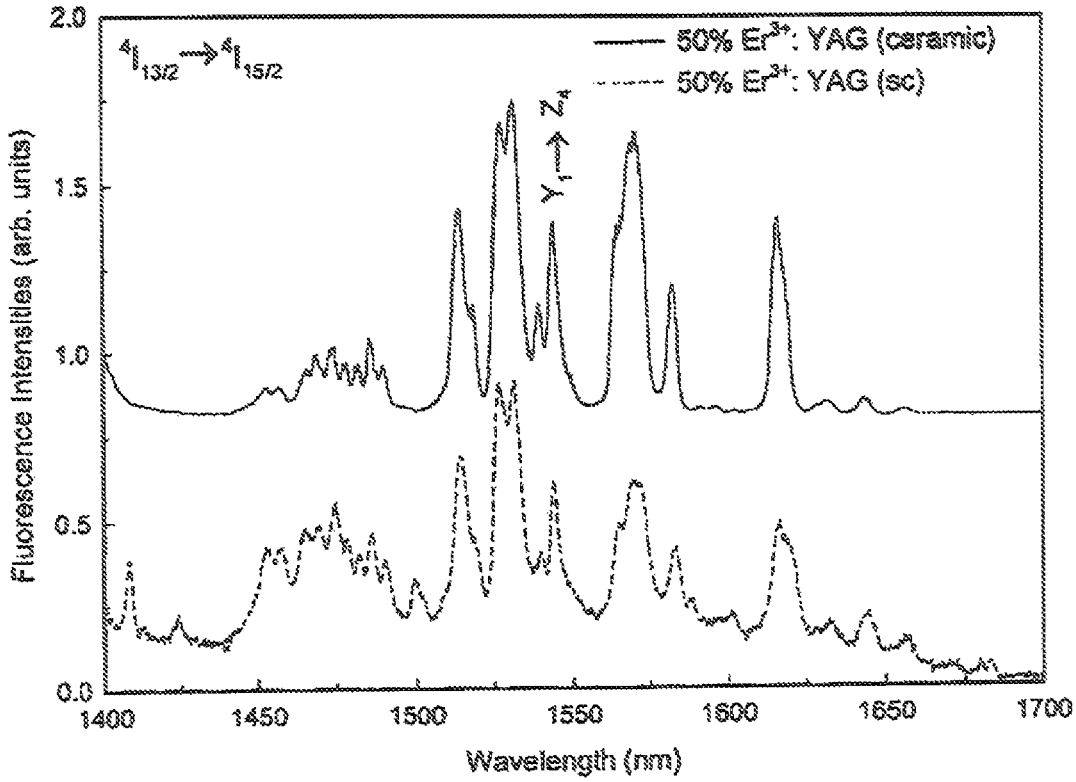
FIG. 3 illustrates the published emission behavior of a typical inorganic yttrium aluminum garnet doped with erbium rare earth ions showing emission behavior in the 1400 to 1700 nm infrared wavelength range.

FIG. 3 illustrates the emission behavior of a typical inorganic yttrium aluminum garnet with erbium rare earth active ions showing emission behavior in the 1600 to 2200 nm infrared wavelength range as published by Sardar et al. "Absorption intensities and emission cross section of principal intermanifold and inter-Stark transitions of Er3+(4f11) polycrystalline ceramic garnet $Y_3Al_5O_{12}$," Journal of Applied Physics, 97, 123501 (2005).

Figure 4:
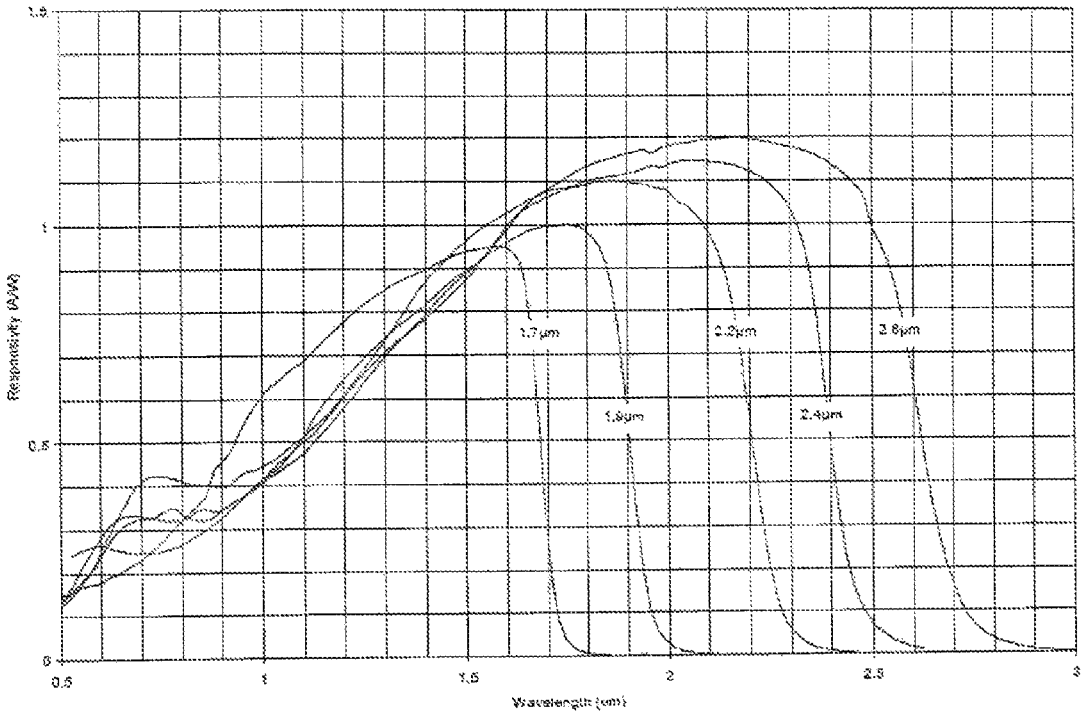
FIG. 4 illustrates a family of typical commercial InGaAs infrared detectors showing detection capability from the edge of the visible spectrum to about 2200 nm.

FIG. 4 illustrates a family of typical commercial InGaAs infrared detectors showing detection capability from the edge of the visible spectrum to about 2200 nm.

Figure 5:
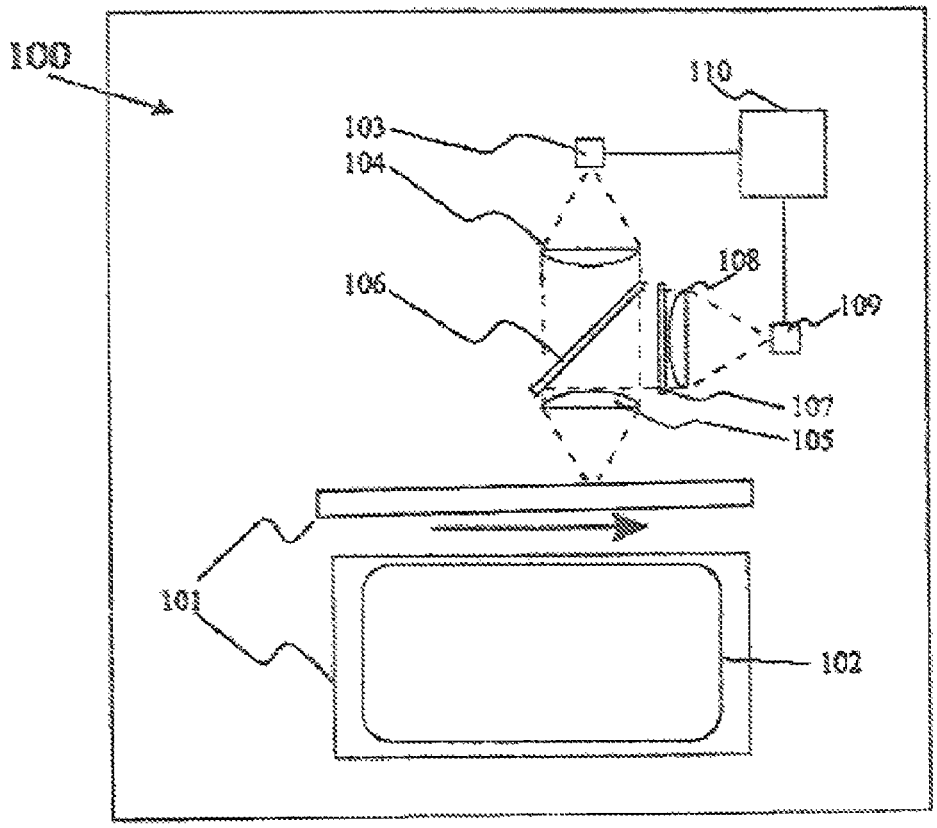
FIG. 5 illustrates a schematic arrangement of one example of a moving value document authentication system of the present technology.

FIG. 5 illustrates a schematic arrangement of a moving value document authentication apparatus 100. The value document 101 travels through the authentication apparatus. The value document 101 has printed ink 102 incorporated with taggant. The taggant receives incoming exciting infrared radiation at a typical wavelength of 1550 nm from a light emitting diode (LED) 103. The LED 103 light is collimated by lens system 104 and 105 to illuminate the value document 101 either as a spot or as a line or a wide area. The infrared emission from the taggant in the range of about 1400 nm to about 2200 nm is directed to the detector 109 by a reflecting mirror 106, optical filter 107 and focusing lens 108. The processing unit 110 supplies power to the LED 103, drives the value document through the authentication apparatus and receive the detected infrared radiation emission data. If the detector 109 receives and passes appropriate wavelength infrared emission from the taggant incorporated within the printed ink 102 on the value document 101 to the processing unit 110, the value document 101 is then deemed authentic, or otherwise, it is rejected as a counterfeit.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A taggant comprising: an inorganic crystal lattice which comprises at least a first rare earth active ion and a second rare earth active ion; wherein the first rare earth active ion absorbs exciting incident infrared radiation having a first wavelength of about 1300 nm to about 2200 nm, and transfers energy to the second rare earth active ion, and the second rare earth active ion emits infrared radiation at a second wavelength of about 1400 nm to about 2200 nm that is greater than the first wavelength of the exciting incident infrared radiation.

2. The taggant according to claim 1, wherein the taggant comprises at least two rare earth active ions from the rare earth elements selected from the group consisting of erbium, holmium, thulium, praseodymium, dysprosium, neodymium, and mixtures thereof.

3. The taggant according to claim 1, wherein the inorganic crystal lattice is selected from a group consisting of aluminates, borates, garnets, oxides, silicates, fluorides, germanates, molybdates, oxyfluorides, oxysulfides, phosphates, tungstates; niobates, tantalates, vanadates, and combinations thereof.

4. The taggant according to claim 1, wherein the first wavelength is in the range of about 1400 to about 1900 nm.

5. The taggant according to claim 1, wherein the second wavelength is in the range of about 1700 to about 2200 nm.

6. A value document comprising: a taggant, the taggant having an inorganic crystal lattice comprising at least a first rare earth active ion and a second rare earth active ion; wherein the first rare earth active ion absorbs exciting incident infrared radiation having a first wavelength of about 1300 to about 2200 nm, and transfers energy to the second rare earth active ion, and the second rare earth active ion emits infrared radiation at a second wavelength of about 1400 to about 2200 nm that is greater than the first wavelength of the exciting incident infrared radiation.

7. The value document according to claim 6, wherein the value document comprises printed matter and the taggant is present in the printed matter in an amount from 0.01% to 40% by weight of the printed matter.

8. The value document according to claim 6, wherein the first and second rare earth active ions are each selected from the group consisting of erbium, holmium, thulium, praseodymium, dysprosium, neodymium, and mixtures thereof.

9. The value document according to claim 6, wherein the inorganic crystal lattice is selected from a group consisting of borates, garnets, fluorides, germinates, molybdates, oxyfluorides, oxysulfides, phosphates, tungstates and vanadates.

10. The value document according to claim 6, wherein the first wavelength is in the range of about 1400 to about 1900 nm.

11. The value document according to claim 6, wherein the second wavelength is in the range of about 1700 to about 2200 nm.

12. A method for authenticating a value document comprising: a) providing a value document to an authentication apparatus, the value document comprising a taggant including an inorganic crystal lattice that includes at least a first rare earth active ion and a second rare earth active ion, wherein the first rare earth active ion absorbs exciting incident infrared radiation having a first wavelength of about 1300 to about 2200 nm and transfers energy to the second rare earth active ion, and the second rare earth active ion emits infrared radiation at a second wavelength that is greater than the first wavelength of the exciting incident infrared radiation; b) providing exciting incident infrared radiation of the first wavelength to the taggant with an infrared illumination source of the authentication apparatus; c) detecting infrared radiation emitted from the second rare earth active ion with an infrared detector of the authentication apparatus and producing emission data from the infrared detector; d) verifying that the emission data is within pre-selected validation criteria with a processing unit of the authentication apparatus; and e) outputting authentication data from the processing unit to authenticate or reject the value document.

13. The method according to claim 12, wherein the value document comprises printed matter and the taggant is present in the printed matter in an amount from 0.01% to 40% by weight of the printed matter.

14. The method according to claim 12, wherein the first and second rare earth active ions are each selected from the group consisting of erbium, holmium, thulium, praseodymium, neodymium, and mixtures thereof.

15. The method according to claim 12, wherein the inorganic crystal lattice is selected from a group consisting of aluminates, borates, garnets, oxides, silicates, fluorides, germanates, molybdates, oxyfluorides, oxysulfides, phosphates, tungstates, niobates, tantalates, vanadates, and combinations thereof.

16. The method according to claim 12, wherein the infrared illumination source is a light emitting diode.

17. The method according to claim 12, wherein the detector is an InGaAs infrared detector.

18. The method according to claim 12, wherein the detector further comprises a filter.

* * * * *